United States Patent [19]

Rumage et al.

[11] Patent Number: 4,530,419

[45] Date of Patent: Jul. 23, 1985

[54] COMBINED STANDING AND BODY SUPPORT FOR A PERSON

[75] Inventors: Donald V. Rumage; Terry L. Biarnesen, both of Racine, Wis.

[73] Assignee: Donald V. Rumage, Racine, Wis.

[21] Appl. No.: 489,725

[22] Filed: Apr. 29, 1983

[51] Int. Cl.[3] ..... B25H 5/00

[52] U.S. Cl. ..... 182/106; 182/116; 182/127; 280/32.5

[58] Field of Search ..... 182/116, 127, 106, 129, 182/63, 17; 280/32.5, 32.6

[56] References Cited

U.S. PATENT DOCUMENTS

| | | | |
|---|---|---|---|
| 2,388,892 | 11/1945 | Wilson | 182/106 |
| 2,479,736 | 8/1949 | Fieroh | 182/17 |
| 2,701,168 | 2/1955 | Schemers | 182/116 |
| 2,732,118 | 1/1956 | Reinhardt | 182/116 |
| 2,872,252 | 2/1959 | Konkle | 182/142 |
| 2,957,541 | 10/1960 | Everest et al. | 182/115 |
| 2,969,123 | 1/1961 | Jamerson | 182/17 |
| 2,970,668 | 2/1961 | Snyder | 182/116 |
| 3,976,155 | 8/1976 | Esch | 280/32.5 |
| 4,072,209 | 2/1978 | Bolis | 182/116 |

*Primary Examiner*—Reinaldo P. Machado
*Attorney, Agent, or Firm*—Arthur J. Hansmann

[57] ABSTRACT

A combined standing and body support for a person working in elevated position and leaning over the work. A base frame provides a support for an upstanding super structure which carries both standing platforms and a body support. The platforms are movable and permit various elevations of standing, and the body support is movable in the vertical direction and in the horizontal directions. A body guard is provided for protecting against falling off the super structure. A counterweight is positioned on one end of the base frame to balance the weight of the user on the super structure which is at the other end of the base frame.

17 Claims, 4 Drawing Figures

COMBINED STANDING AND BODY SUPPORT FOR A PERSON

This invention relates to a combined standing and body support for a person wherein the person can stand on a platform and simultaneously lie on a body support, such as for working on an automobile, truck, or any other type of work where that position is desirable.

BACKGROUND OF THE INVENTION

The prior art is already aware of various forms of supports for a person in a working position. U.S. Pat. Nos. 2,701,168 and 2,872,252 and 2,957,541 and 2,969,123 and 2,970,668 and 3,976,155 and 4,072,209 show these supports. Those are supports for a person in a semi-reclining working position where one can lie on his stomach while performing work at a level below his torso, such as when working in an automobile or truck engine compartment. However, those patents differ from the present invention in that their upright posts or supports are different, their standing supports are different, their body support is different, particularly in the movement or adjustability of the body support in the present invention, they do not provide the overall extension or adaptability of the present invention, they do not provide the positioning, relative to the vehicle wheels or the like, compared to the present invention, they do not provide a body guard for the user, they do not provide a protector or bumper for the vehicle or the like, just to mention some of the differences.

Accordingly, it is an object of this invention to provide an improvement upon the prior art, as mentioned above. Specifically, the present invention improves upon the prior art in the respects mentioned and also by providing movable expanding platforms which can be moved out of the way in accordance with the desired elevation for the user.

Still further, the present invention provides the combined standing and body support for work on vehicles, for instance, wherein the support need not extend underneath the vehicle and it therefore need not encounter the vehicle wheel and therefore can be positioned in any desired position relative to the portion of the vehicle being worked upon.

DETAILED DESCRIPTION OF THE PREFERRED EMBODIMENTS

Figure 2:
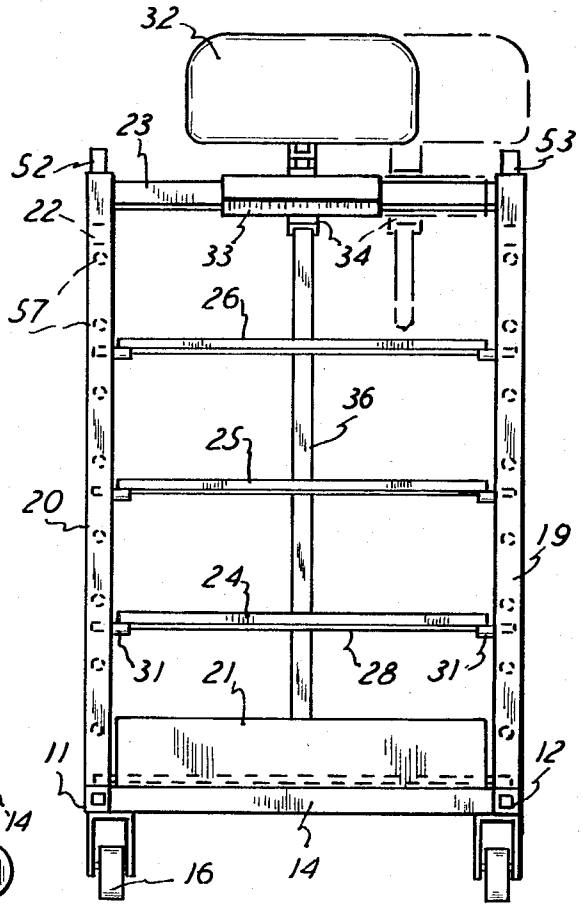
FIG. 2 is a front elevational view of FIG. 1, and showing some parts in a adjusted position.
Figure 3:
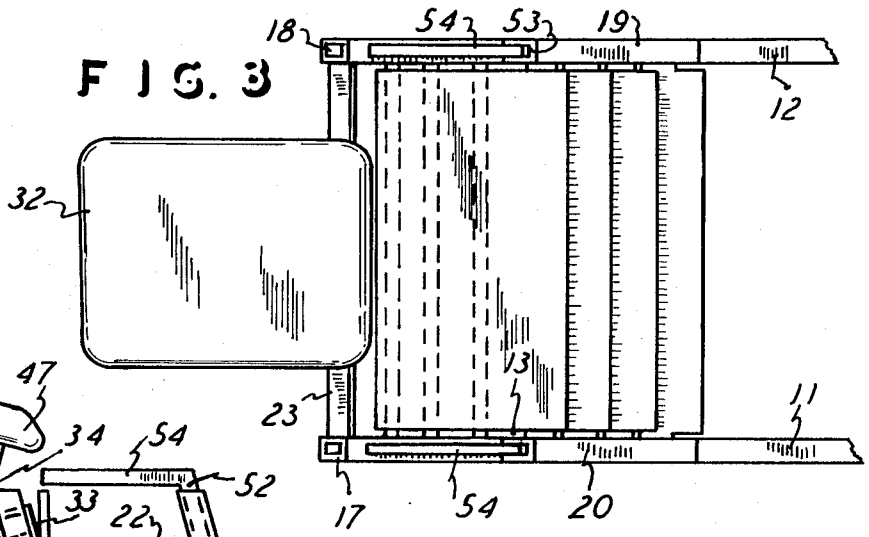
FIG. 3 is a top plan view of a fragment of FIG. 1.
Figure 1:
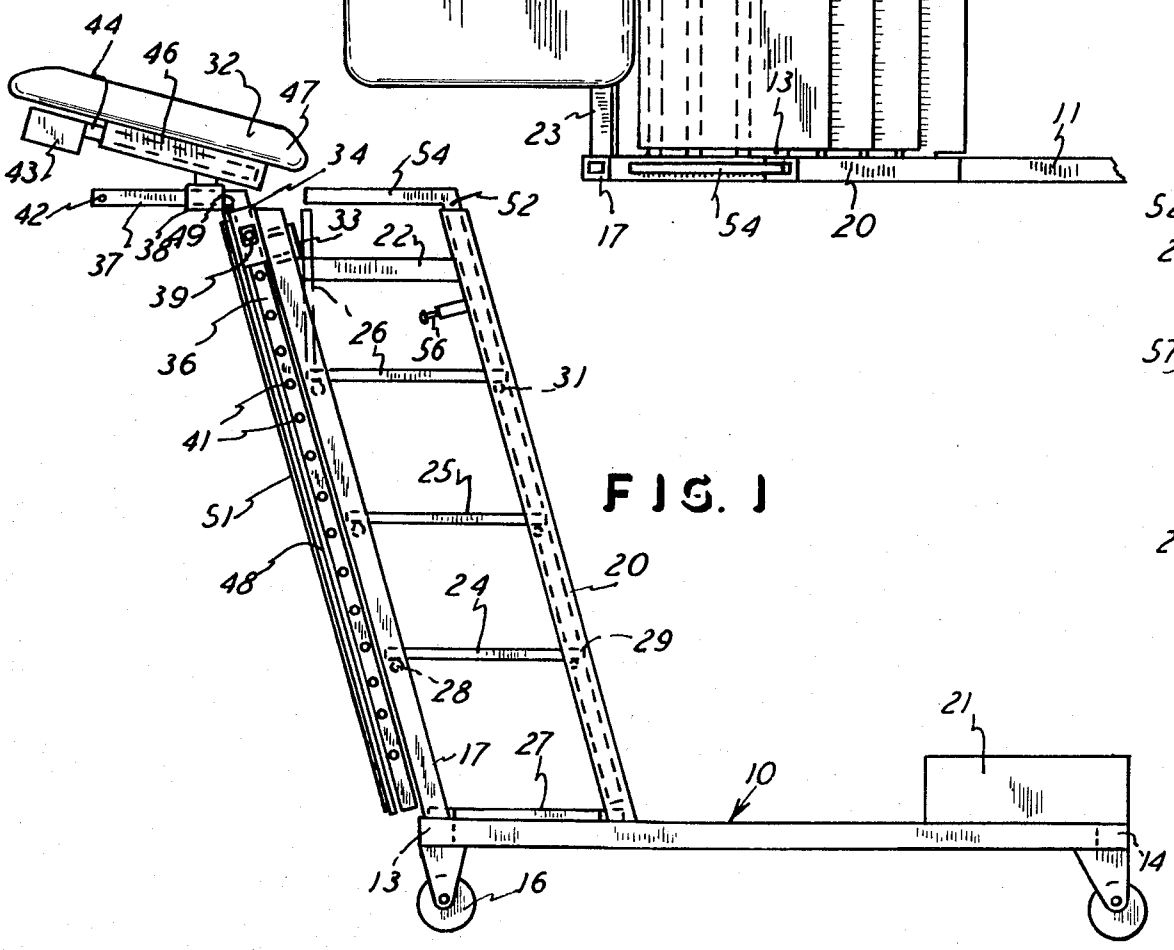
FIG. 1 is a side elevational view of one embodiment of this invention.

FIGS. 1 through 3 show an embodiment where a counter-weight is employed so that no part of the embodiment is required to move underneath the vehicle and thus endeavor to avoid the wheels or the like. In that arrangement, there is a base frame generally designated 10 and consisting of two side frame pieces or tubes 11 and 12 and two end connecting pieces or tubes 13 and 14. Thus a rectangular frame 10 is formed and it is horizontally disposed and it is shown to be mobile by virtue of four wheels 16 attached thereto.

Figure 4:
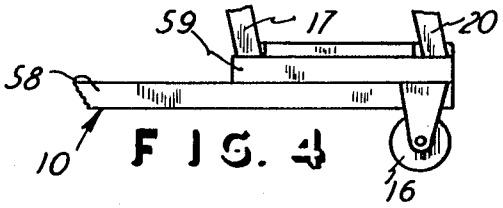
FIG. 4 side elevational view of a fragment of another embodiment, similar to FIG. 1.

Four rectangularly spaced apart upright tubes or standards 17, 18, 19, and 20, are suitably affixed at their lower ends to the base frame 10 and extend uprightly therefrom at the inclined angle, such as shown in FIGS. 1 and 4. These four standards may be welded to the adjacent pieces of the base frame 10, or otherwise suitably connected to be rigid therewith. The drawings show the four standards to be parallel to each other and inclining at an angle 15 degrees off the vertical. It is critical and important that the standards be at an inclination of between 10 and 20 degrees, for the purpose of suitably balancing a person on the support and for providing the counter-balance of the unit, such as by the weight 21 on the end of the frame adjacent the frame piece 14. That is, the one end of the frame 10 receives the four standards, as shown, and the other extreme end receives the counter-weight 21 so that a person can be within the confines of the standards 17, 18, 19, and 20 and be counter-balanced by the appropriate amount of weight 21. Also, the inclination of the standards is important relative to the ladder effect provided by the standards, as described later. The standards thus extend upwardly and a frame member 22 is affixed to the upper ends of each of the two side standards, and another frame piece 23 extends across the width of the support between the upper ends of the standards 17 and 18 and is affixed thereto so that the frame pieces 22 and 23 form the rigid upright super structure with the four standards described and shown. FIG. 2 shows that one can enter between the two side standards, as viewed in FIG. 2, and thus be positioned within the confines of the four standards.

Several standing platforms 24, 25, and 26 are suitably movably mounted on the four standards to extend in the space therebetween, so that one can climb upwardly along the standards by stepping onto the several platforms. Of course one can also stand on any one of the three movable platforms mentioned in order to be at an appropriate elevational for performing the work mentioned. Also, a lower platform 27 is at the elevation of the base frame 10 and is available for standing at that elevation if and when desired. Further, the platforms are all movable, and they are shown to be pivotally mounted relative to the standards 17 and 18, and the showing is by means of a rod 28 extending between and into the standards 17 and 18 and being affixed to each respective platform 24, 25, and 26. Thus, with the front ends, such as the end 29 of the lower standard 24, being free of any connection, the platforms can pivot upwardly, such as to the dot-dash line position shown with respect to the platform 26. In that position, the platforms are in the overcenter position and thus are up and out of the way so that one can stand on a lower platform and also the upwardly pivotted platform will not fall down but can be readily positioned to its lowered and operative position rather than being up in its inoperative or non-use position as shown in the dot-dash lines. In the lowered position, two side abuttments or pins 31, for each platform, extend from the standards 19 and 20 and engage the extending and lower edges of the respective platforms for positioning the platforms in the horizontal positions shown in full lines in FIGS. 1 and 2.

In that respect, the unit is like a ladder in that one can walk up the platforms from the bottom to the upper one 26 and stand thereon, or, the platform 26 can be raised to its dot-dash line position and one can then comfortably stand on the platform 25, for instance.

When the user desires to lean over in the engine compartment of a vehicle, for instance, then his stomach can be resting on the body support 32 which is movably connected with the super structure of the four standards described. The shown connection is with the rectangular sleeve 33 horizontally slidable on the correspondingly rectangular member 23, so that the sleeve can slide to the dot-dash position shown on the right in FIG. 2, for instance. That of course would position the body support 32 over to the right relative to the super structure or the four standards, if and when that position is desired by the user. A collar 34 is affixed to the sleeve 33, and it is preferably of a rectangular configuration having a rectangular opening into which a rectangular rod 36 extends. The upper end of the rod or member 36 has a horizontally extending angled end 37 on which a sleeve 38 is horizontally slidably mounted and which in turn provides the connection for the body support 32 to the remainder of the unit shown and described. Thus, the rod 36 can slide up and down in the collar 34, and the sleeve 38 can slide horizontally along the rod horizontal end 37. That, in addition to the sliding of the sleeve 33 on the member 23, provides universal positioning for the body support 32 relative to the super structure. Still further, that is to say the body support 33 can be positioned left and right and toward and away relative to the position of the user on the platforms 24, 25, 26, or 27.

When the support 32 is to be raised from the position shown in the drawings, then the rod 36 can slide upwardly in the collar 34, and a pin 39 connected with the collar 34 can be received in the selective one of the laterally extending and spaced apart openings 41 in the rod 36 to thus secure the rod in its desired elevated position and thereby firmly support the body support in a position desired. Additionally, a stop pin 42 is on the end of the rod end 37 to preclude the sleeve 38 from sliding off the end 37. Also, a tool box 43 or the like is affixed with the body support 32 and has an arm 44 in a sleeve 46 so that it can slide out beyond the cushion portion 47 of the body support 32 for holding parts, tools, or the like, as desired.

FIG. 1 further shows a back-up member 48 affixed to the rod 36 at the location designated 49 to move laterally and vertically with the rod 36, and the plate 48 has a bumper strip 51 of resilient and cushioning material extending therealong and thus available for facing the vehicle body, fender, or the like and avoid marring. Thus, when the body portions 32 is extended upwardly, and that would be by means of raising the rod 36, the bumper 51 also extends upwardly so that it is in the likely position of protecting the high vehicle body or fender against marring, and the connection with the rod 36 can be by welding or any suitable manner with the upper end of the plate 48, as mentioned.

The two standards 19 and 20 are indicated as rectangular hollow tubes, and they each receive an elongated rod 52 and 53, respectively. Those rods 52 and 53 are also of rectangular configuration for snug sliding within the two standards, and they each present the horizontal offset end 54, as shown. Those ends 54 extend along the space between the pairs of side standards described, and, as such, they serve as body guards for the person standing on any one of the four platforms. Further, FIG. 2 shows that the rods 52 can be secured in any upwardly extending position, such as by means of the pin 56 mounted on each standard 19 and 20 and extending into one of the number of pin holes 57 in each rod 52 and 53. Therefore, the offsets 37 and 54 on their respective rods 36 and 52 can be positioned at the same elevation so that the user will have the benefit of the body guard 52 and 53 in the elevated position.

FIG. 4 shows a somewhat different arrangement for the base frame 10, and, in that instance, the counterweight 21 is not used but instead the frame 10 has its two spaced-apart frame pieces extending to the left, as viewed in FIG. 4, and those would be according to piece 58. The four standards 17, 18, 19, and 20 would be utilized, according to the description in FIG. 1 and as shown with respect to the two standards 17 and 20 in FIG. 4. Also, a frame piece 59 is shown as a part of the base frame 10 and of course is rigidly secured thereto, such as by welding, so that the four upright standards described can be welded at their lower ends to the piece 59. Finally, the unit in FIG. 4 is also mobile, such as by means of the wheel 16. In that instance, the frame pieces 58 would extend underneath the vehicle, rather than away from the vehicle as described in connection with FIG. 1, but, as mentioned and except for that which is seen in FIG. 4, the remainder of the entire is otherwise the same.

Thus, the rods 36 and 52 relate to the super structure by being vertically movable relative thereto and having the pin and hole type of lock means shown and described. Also, the bumper 51 is of a rubber or vinyl or like material to avoid marring. In FIG. 1, the body support 32 is disposed in a position which is offset from the vertical projection of the base frame 10 which can therefore be back away from the vehicle and allow sufficient approach and access to the vehicle by an person on the body support 10. Further, there is a first slidable interconnector, such as the collar 34, and there is a second slidable interconnector, such as the sleeve 49, and there is a third slidable interconnector, such as the sleeve 33, all for universal positioning of the body support 32.

What is claimed is:

1. A ladder with an extendible body support, comprising a base frame, a super structure mounted on said base frame and extending thereabove, ladder platforms spaced along said super structure for supporting a person in a standing position at selected elevations, a body support on the upper end of said super structure, a first slidable interconnector interposed between said body support and said super structure for selective vertical positioning of said body support relative to said super structure, a second slidable interconnector interposed between said body support and said super structure for horizontal positioning of said body support relative to said super structure along one horizontal line, and a third slidable interconnector interposed between said body support and said super structure for horizontal positioning of said body support relative to said super structure along another horizontal line.

2. The ladder with an extendible body support as claimed in claim 1, wherein said platforms are movable mounted on said super structure for separate movement to positions of non-use.

3. The ladder with an extendible body support as claimed in claim 1, wherein said platforms are pivotally mounted on said super structure for separate movement to over-center upright positions of non-use.

4. The ladder with an extendible body support as claimed in claim 1, including a guard member uprightly slidably mounted on said super structure on opposite sides of said platforms and being vertically movable for protecting the person standing on said platform.

5. The ladder with an extendible body support as claimed in claim 1, including lock means interconnected between said super structure and said body support for releasably locking said body support in selected elevated positions relative to said super structure.

6. The ladder with an extendible body support as claimed in claim 1, wherein said super structure includes four rectangularly spaced apart and uprightly extending standards affixed relative to each other, and said platforms extending between said four standards.

7. The ladder with an extendible body support as claimed in claim 4, wherein said super structure includes four rectangularly spaced apart and uprightly extending standards affixed relative to each other, and said platforms extending between said four standards, and wherein said guard member extends in line with the two of said standards on each opposite side of said platforms.

8. A standing support with a body support, comprising a base frame having a horizontal extent between two opposite ends, a super structure mounted on said base frame at one extreme end of said two opposite ends and extending upwardly therefrom at an angle of 10 to 20 degrees relative to the vertical and in the direction away from the other end of said base frame, a standing platform mounted on said super structure for standing support of a person, a body support mounted on the upper end of said super structure for lying support of a person while also standing on said platform, said body support being disposed beyond the vertical plane across said one extreme end of said base frame to thereby be outside the plane of the vertical projection of said base frame, and a counterweight on said other end of said base frame for balancing the person on said platform and said body support.

9. The standing support with a body support as claimed in claim 8, including a plurality of said platforms movably mounted in vertically spaced apart positions along said super structure.

10. The standing support with a body support as claimed in claim 9, wherein said platforms are pivotally mounted on said super structure and pivot upwardly to over-center inoperative positions on the inclined said super structure.

11. The standing support with a body support as claimed in claim 8, including a bumper of resilient cushioning material attached to said super structure and extending upwardly therealong on the outside surface thereof for serving as a bumper between said super structure and foreign objects, said body support and said bumper being connected together, and a connector interposed between said body support and said super structure for vertical movement of said body support and said bumper relative to said super structure.

12. A standing support with a body support, comprising a horizontally extending base frame having two opposite ends, four rectangularly spaced apart standards fixedly mounted on said base frame adjacent only one of said two ends and extending upwardly therefrom in an inclined direction away from the other of said two ends, a body support mounted on two of said four standards and extending horizontally away from said standards to be horizontally offset relative to said standards for supporting the body of a person, standing platforms movably mounted on said standards and vertically spaced therealong for standing support of a person, and said four standards being affixed to said base frame only at said one end of said base frame, all presenting said body support offset from the vertical projection of said base frame.

13. The standing support with a body support as claimed in claim 12, including a slide connector interconnected with and disposed between said two standards and being vertically movable thereon, and said body support mounted on said slide connector for vertical movement of said body support relative to said standards.

14. A standing support with a body support, comprising a mobile base frame, a super structure mounted on said base frame and extending upwardly therefrom, a standing platform mounted on said base frame and extending upwardly therefrom, a standing platform mounted on said super structure for standing support of a person, a body support mounted on said super structure for lying support of the person who is also standing on said platform, a bumper of resilient cushioning material attached to said super structure and extending upwardly therealong on the outside surface thereof for serving as a bumper between said super structure and foreign objects, said body support and said bumper being connected together, a connector interposed between said body support and said super structure for vertical movement of said body support and said bumper relative to said super structure, a second slidable connector interposed between said body support and said super structure for horizontal positioning of said body support relative to said super structure along one horizontal line, and a third slidable connector interposed between said body support and said super structure for horizontal positioning of said body support relative to said super structure along another horizontal line.

15. A standing support with a body support, comprising a base frame, a super structure fixedly mounted on said base frame and extending upwardly therefrom, a body support mounted on said super structure and extending horizontally away from said super structure to be offset relative to said super structure for supporting the body of a person, standing platforms movably mounted on said super structure and vertically spaced therealong for standing support of a person, said super structure being affixed to said base frame at only one end of said base frame, a slide connector interconnected between said super structure and said body support for vertical movement of said body support relative to said super structure, and a body guard slidably connected with said super structure for vertical movement of said body guard relative to said super structure.

16. The standing support with a body support as claimed in claim 15, including a second slide connector interconnected between said super structure and said body support for horizontal movement of said body support relative to said super structure along one line.

17. The standing support with a body support as claimed in claim 16, including a third slide connector interconnected between said super structure and said body support for horizontal movement of said body support relative to said super structure along a line transverse to said one line.

* * * * *